US007236071B2

(12) United States Patent
Prestini et al.

(10) Patent No.: US 7,236,071 B2
(45) Date of Patent: Jun. 26, 2007

(54) MEDIUM VOLTAGE VACUUM CONTACTOR

(75) Inventors: Osvaldo Prestini, Nembro (IT); Alberto Zulati, Bergamo (IT)

(73) Assignee: ABB Technology AG, Zurich (CH)

( * ) Notice: Subject to any disclaimer, the term of this patent is extended or adjusted under 35 U.S.C. 154(b) by 52 days.

(21) Appl. No.: 11/177,309

(22) Filed: Jul. 11, 2005

(65) Prior Publication Data

US 2006/0006146 A1 Jan. 12, 2006

(30) Foreign Application Priority Data

Jul. 12, 2004 (EP) ..... 04077007

(51) Int. Cl.
*H01H 9/00* (2006.01)
*H01H 9/02* (2006.01)

(52) U.S. Cl. ..... 335/177; 335/179; 335/202; 335/262; 218/140; 218/141; 218/142; 218/154

(58) Field of Classification Search ..... 335/177–180, 335/202, 229–234, 261, 262; 218/118, 140–142, 218/154

See application file for complete search history.

(56) References Cited

U.S. PATENT DOCUMENTS 3,699,486 A * 10/1972 De Lucia ..... 335/131
2004/0093718 A1 5/2004 Takeuchi et al.

FOREIGN PATENT DOCUMENTS

| | | |
|---|---|---|
| DE | 1 225 609 A2 | 7/2002 |
| DE | 102 38 950 A1 | 3/2004 |
| DE | 103 39 214 A1 | 3/2004 |
| EP | 0 867 903 A2 | 9/1998 |
| FR | 2 841 683 A1 | 1/2004 |
| GB | 1008735 | 11/1965 |
| GB | 1 559 373 | 1/1980 |

* cited by examiner

*Primary Examiner*—Ramon M. Barrera
(74) *Attorney, Agent, or Firm*—Buchanan Ingersoll & Rooney PC

(57) ABSTRACT

A medium voltage vacuum contactor comprising for each pole, a vacuum envelope which contains a fixed contact and a corresponding movable contact; and actuating means providing the energy required to move the movable contacts, characterized in that said actuating means comprise an electromagnetic actuator having: a magnetic yoke which has an inner cavity communicating with the outside through at least a first opening; at least one coil accommodated in the cavity; a movable armature which is operatively connected to at least one movable contact through coupling means, and is mounted axially displaceable in the cavity with at least one end protruding from the first opening; at least one permanent magnet devoted to directly hold the movable armature in two stable positions. Further, there are provided means for guiding the movement of the movable armature which are positioned outside the yoke in correspondence of at least the first opening.

10 Claims, 6 Drawing Sheets

MEDIUM VOLTAGE VACUUM CONTACTOR

The present invention relates to a medium voltage vacuum contactor, preferably for applications with operating voltages ranging between 3 and 12 kV, having improved functions and characteristics.

It is well known the use in electric systems of two different types of switching devices; a first type is constituted by the so-called protection devices, typically circuit breakers, which are basically suitable for carrying—for a specified time—and breaking currents under specified abnormal circuit conditions, namely short circuits; a second type is constituted by maneuvering switching devices, such as contactors like the one of the present invention, which are capable of making, carrying and breaking currents under normal circuit conditions including overload conditions.

Such contactors, widely used for example to switch on/off electric motors, are required to satisfy a number of conditions which are important to guarantee the proper functional performances during their service life in electrical networks; for example, switching off maneuvers should be carried out in due time, normally as quickly as possible, in order to prevent possible damages to the equipment, the actuating mechanism should be designed so as to ensure an adequate operational repeatability and an optimized reliability, and so on. Currently, there are many different constructive solutions of medium voltage contactors which, despite allowing adequate execution of the performances required, still present some drawbacks and technical aspects which are not entirely satisfying.

In particular, as regard to the actuating mechanisms, more traditional contactors utilize actuation devices of the mechanical type with spring-loaded kinematic systems. For example, a typical configuration of traditional systems encompasses an electromagnet to move an armature which is mechanically linked with the movable contact so as to determine its coupling with the corresponding fixed contact; when electromagnetic energy is removed from the electromagnet, one spring, typically indicated as a kick-out spring, opens the contacts and keeps them open. Alternatively, or in addition, the contacts may be kept in position by using appropriate mechanical latches. Clearly, actuating mechanisms with spring-loaded kinematic systems are inherently complicated and bulky, thus negatively affecting in many cases the whole reliability of the contactors and the repeatability of operations.

More recently, there have been developed actuating mechanisms which use driving units provided with one or more permanent magnets. Such driving units, however, even offering some substantial improvements with respect to traditional electromagnet devices, are still not fully optimized as regard in particular to sizing, number and functioning of the components used that still require in many cases complicated design and shaping in order to achieve a desired electromagnetic and mechanical behavior. For example, in some cases the contacts are kept in at least one of their two stable positions by mechanical systems still using springs and/or mechanical latches; in addition, during operations, the permanent magnets are in some cases de-energized by suitably designed coils and according to solutions which are rather complicated from the structural and electromagnetic point of views. Additional problems are caused in those solutions where guides for guiding the movable armature of the driving actuator are used; such guides are normally positioned inside the driving actuator itself or attached to the movable contacts, thus increasing the mechanical complexity and making the assembly of the parts very difficult.

Further significant problems arise as regard to coupling and transmission systems used between the driving actuator and the movable contacts; indeed, in most cases the actuating force is transmitted to the moving contacts by using an intermediate control leverage, e.g. L-shaped leverages, which normally reverse the direction of the actuating forces. These solutions, apart from resulting in mechanisms overally cumbersome, may negatively influence the electrical life of the contactors, in particular in vacuum contactors. In fact, in this specific type of contactors, the contacts are coupled head-by head; therefore, possible imperfections or unbalance in the mechanism transmitting the actuating force to the contacts, may cause an imperfect mutual positioning between the contact heads thus leading to an uneven wear, to an imperfect current conduction and dissipation, and ultimately even to welding of the contacts.

The aim of the present invention is to realize a medium voltage vacuum contactor which allows to overcome the above mentioned drawbacks, and in particular which has an optimized structure as regard to mechanical and electromagnetic aspects, and provide functional performances improved with respect to known contactors.

Within the scope of this aim, an object of the present invention is to realize a medium voltage vacuum contactor which allows to achieve an improved reliability and repeatability of operations with respect to known solutions, in particular as regard to the kinematic transmission between the driving actuator and the contacts.

Another object of the present invention is to provide a medium voltage vacuum contactor whose constructive architecture is considerably less complicated than known types of contactor, and whose mounting is substantially facilitated.

Not the last object of the present invention is to provide a medium voltage vacuum contactor which is highly reliable, relatively easy to manufacture and at competitive costs. This aim, these objects and others which will become apparent hereinafter are achieved by a medium voltage vacuum contactor as defined in claim 1.

Further characteristics and advantages of the invention will become apparent from the description of preferred but not exclusive embodiments of a medium voltage vacuum contactor according to the invention, illustrated only by way of non-limitative examples in the accompanying drawings, wherein.

Figure 5:
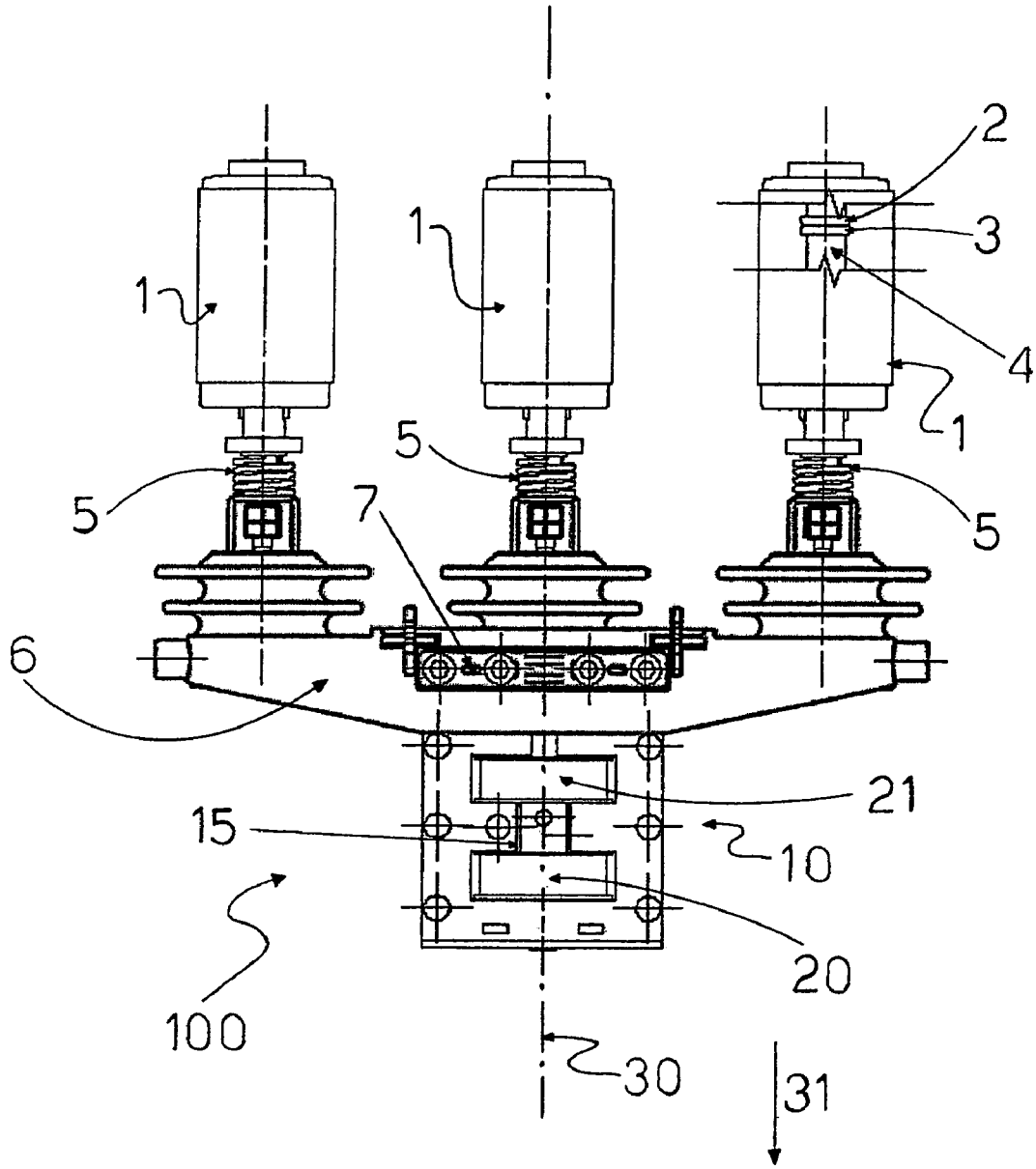
FIG. 5 illustrates a three poles medium voltage vacuum contactor according to the invention, in a closed position.
Figure 6:
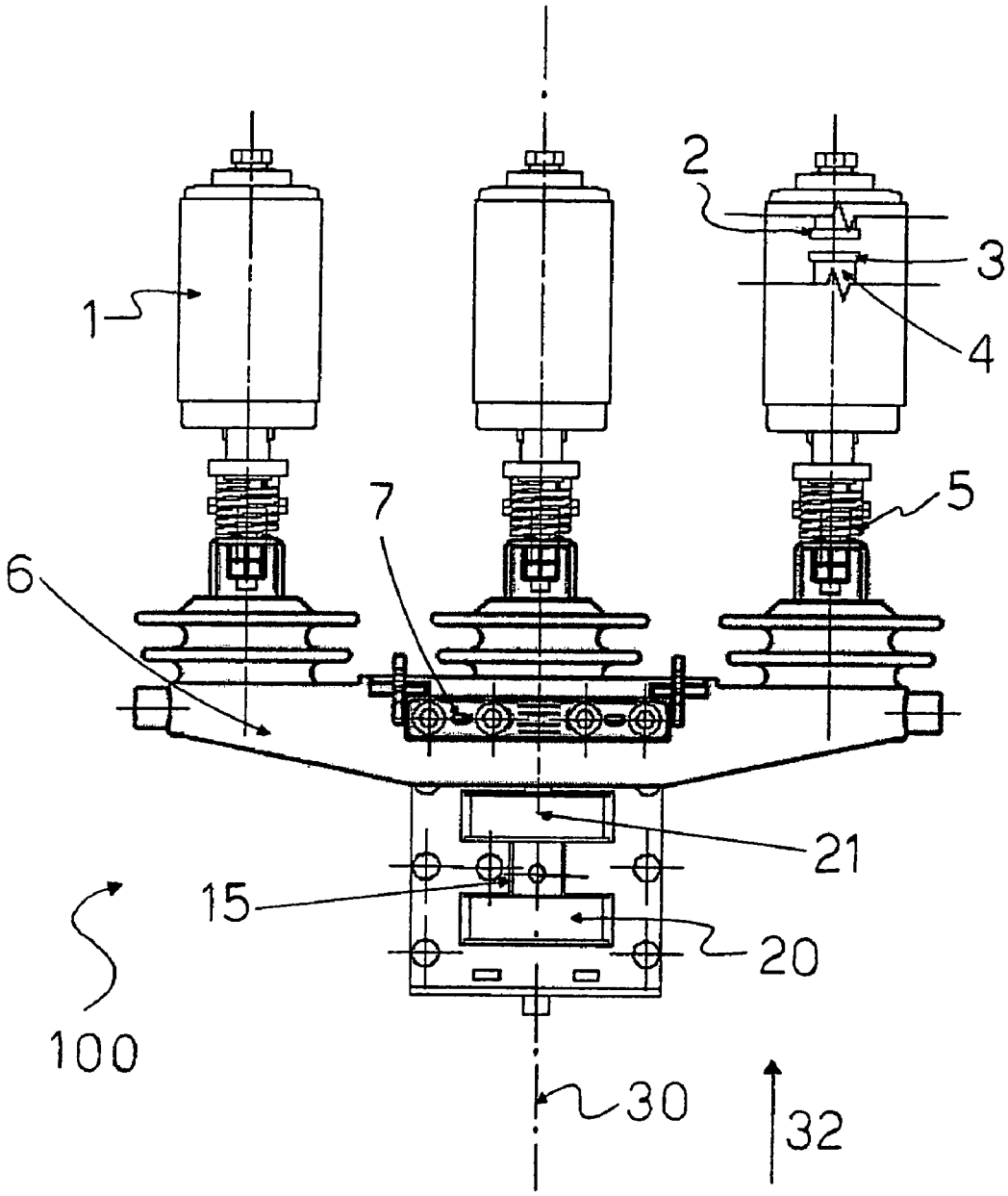
FIG. 6 shows the contactor of FIG. 1 in the open position.

FIGS. 5 and 6 show a three poles medium voltage vacuum contactor generally indicated by the reference numeral 100. The contactor 100 comprises, for each pole, a vacuum envelope 1, e.g. a vacuum bottle or bulb, which contains a fixed contact 2 and a corresponding movable contact 3 illustrated for simplicity only for one pole; possible constructional embodiments of the envelope 1 and the ways in which the vacuum is maintained inside it are widely known in the art and therefore are not described in details herein. According to well known solutions, each movable contact 3 is connected to an actuating rod 4 to which is associated a contact-pressing spring 5.

The contactor 100 further comprises actuating means which are operatively coupled to the movable contacts 3 and provide the energy required for moving them and allowing their electric coupling/separation with respect to the corresponding fixed contacts 2 during operations.

Figure 1:
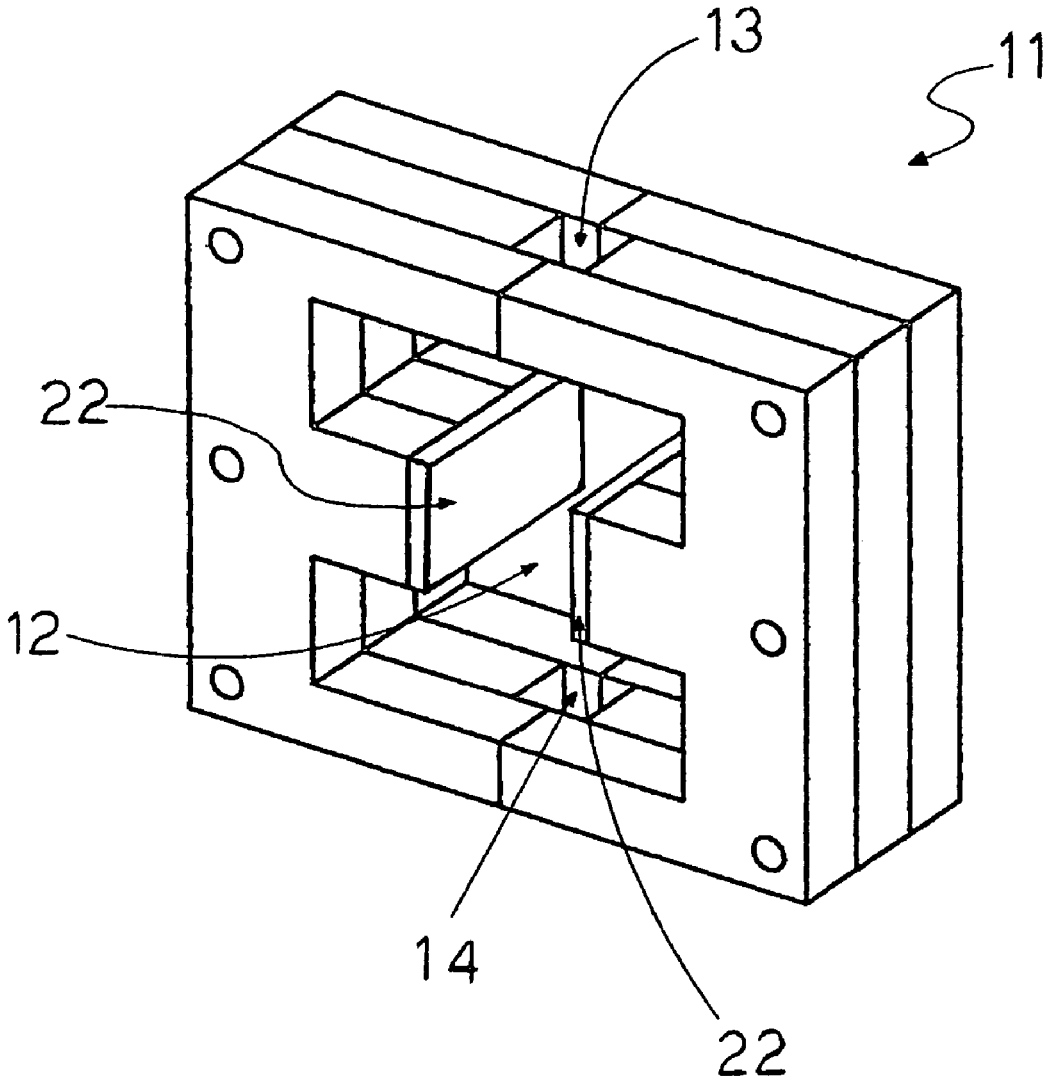
FIGS. 1 and 2 are perspective views illustrating some components of an electromagnetic actuator used in the contactor according to the invention.
Figure 2:
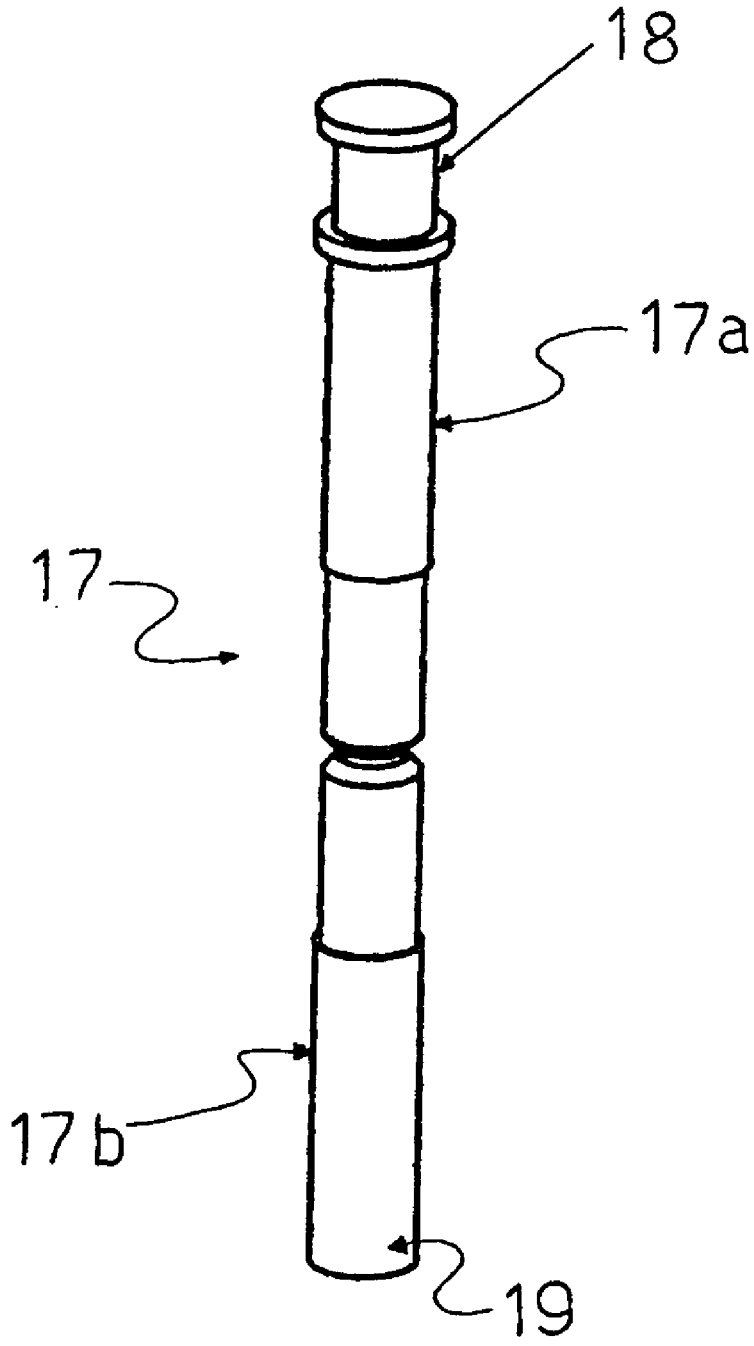
Figure 4:
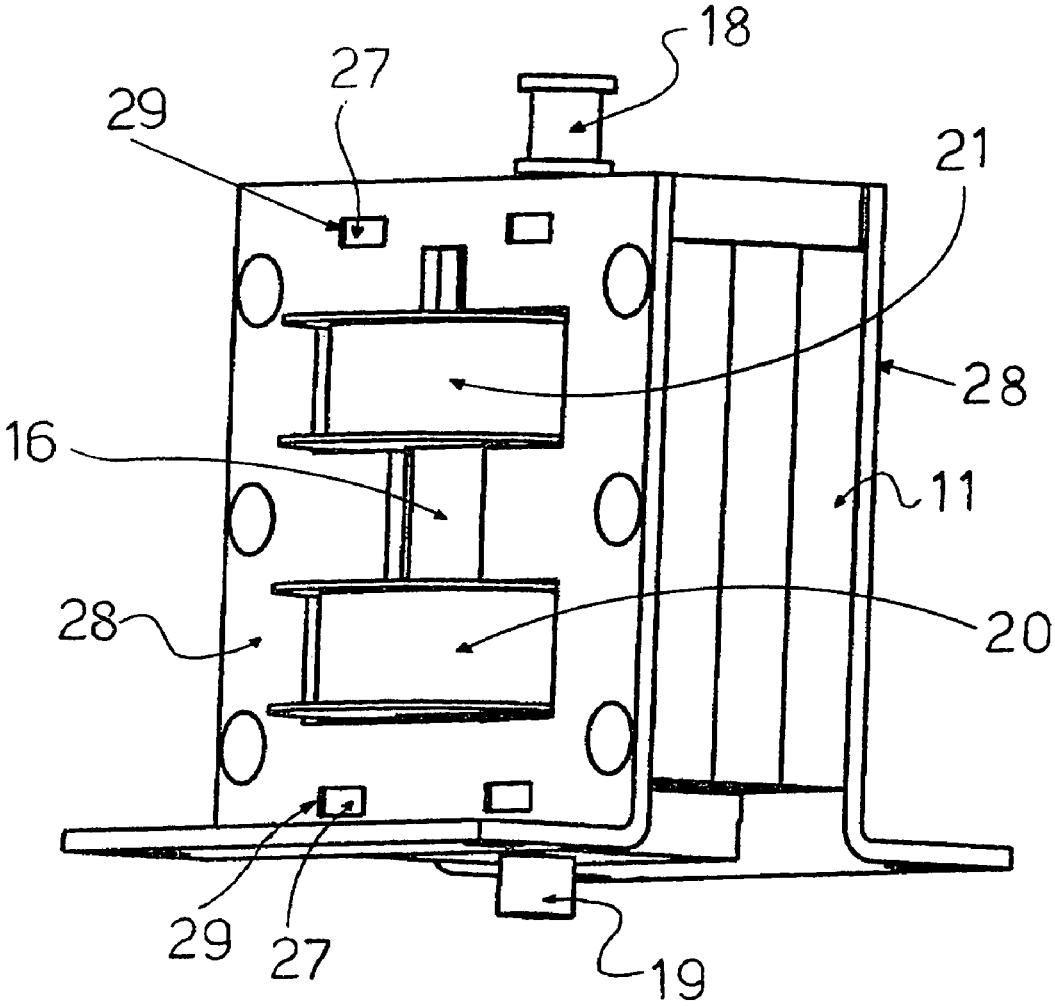
FIG. 4 is a perspective view illustrating an electromagnetic actuator used in the contactor according to the invention coupled to the guiding means of FIG. 3.

Preferably, in the vacuum contactor according to the invention, the actuating means comprise an electromagnetic actuator 10 having a magnetic yoke, indicated in FIG. 1 by the reference 11, which is configured so as to define an inner cavity 12 suitably shaped and communicating with the outside through a first opening 13 and a second opening 14; in the embodiment illustrated, the yoke 11 is formed by two coupled E-shaped parts, but alternatively shapes may be used, provided that they are compatible with the applications and functional needs. The actuator 10 comprises a movable armature 15 which is accommodated in an axially displaceable manner inside the cavity 12 and is operatively connected, through coupling means, to at least one movable contact 3; in particular, the movable armature 15 has at least one end protruding from one corresponding opening of the yoke 11; preferably, in the contactor according to the invention, the armature 15 has two opposite ends each protruding outside the yoke 11 from a corresponding opening 13 or 14. In particular, according to a solution which is structurally simple and functionally effective, the armature 15 comprises, as shown in FIG. 4, a first hollow tubular member 16, e.g. a parallelepiped hollow block, and a pivot 17, illustrated in detail in FIG. 2, which is connected to the member 16 passing through its hollow part, and has two opposite ends 18 and 19 protruding outside the yoke 11. Advantageously, the pivot 17 comprises two separate cantilever-shaped parts, i.e. a male part 17*a* and a female part 17*b* which are screwed each other during mounting with their respective projecting surfaces resting against opposite faces of the member 16; in this way, assembling is extremely simplified.

The actuator 10 comprises also at least one coil which is positioned inside the cavity 12 and is suitable to be energized during operation; preferably, as illustrated in FIGS. 4–6, there are provided two coils, namely a first opening coil 20 which is suitable to be energized during opening of the contactor, and a second closing coil 21 which is suitable to be energized when closing. Preferably, the two coils 20 and 21 are positioned in the inner cavity 12 spaced apart from each other along the axis 30 of displacement of the armature 15 and are positioned in a substantially cylindrical configuration around the movable armature 15 itself. According to a preferred embodiment, the two coils are different to each other; in particular, the ratio between the number of turns of the first coil 20 and of the second coil 21 is comprised between 0.25 and 0.45; further, the ratio between the diameter of the wires of the turns of the first coil 20 and of the second coil 21 is comprised between 1.5 and 1.7.

Advantageously, the actuator 10 comprises also at least one permanent magnet which is coupled to the yoke 11, inside the cavity 12, and is devoted to directly hold said movable armature 15 either in a first stable position in which the fixed and movable contacts 2–3 are electrically coupled and in a second stable position in which the contacts are electrically separated from each other. Preferably, there are provided two permanent magnets 22 which are positioned inside the cavity 12 with their respective north poles facing each other and with the movable armature 15 positioned there between.

Figure 3:
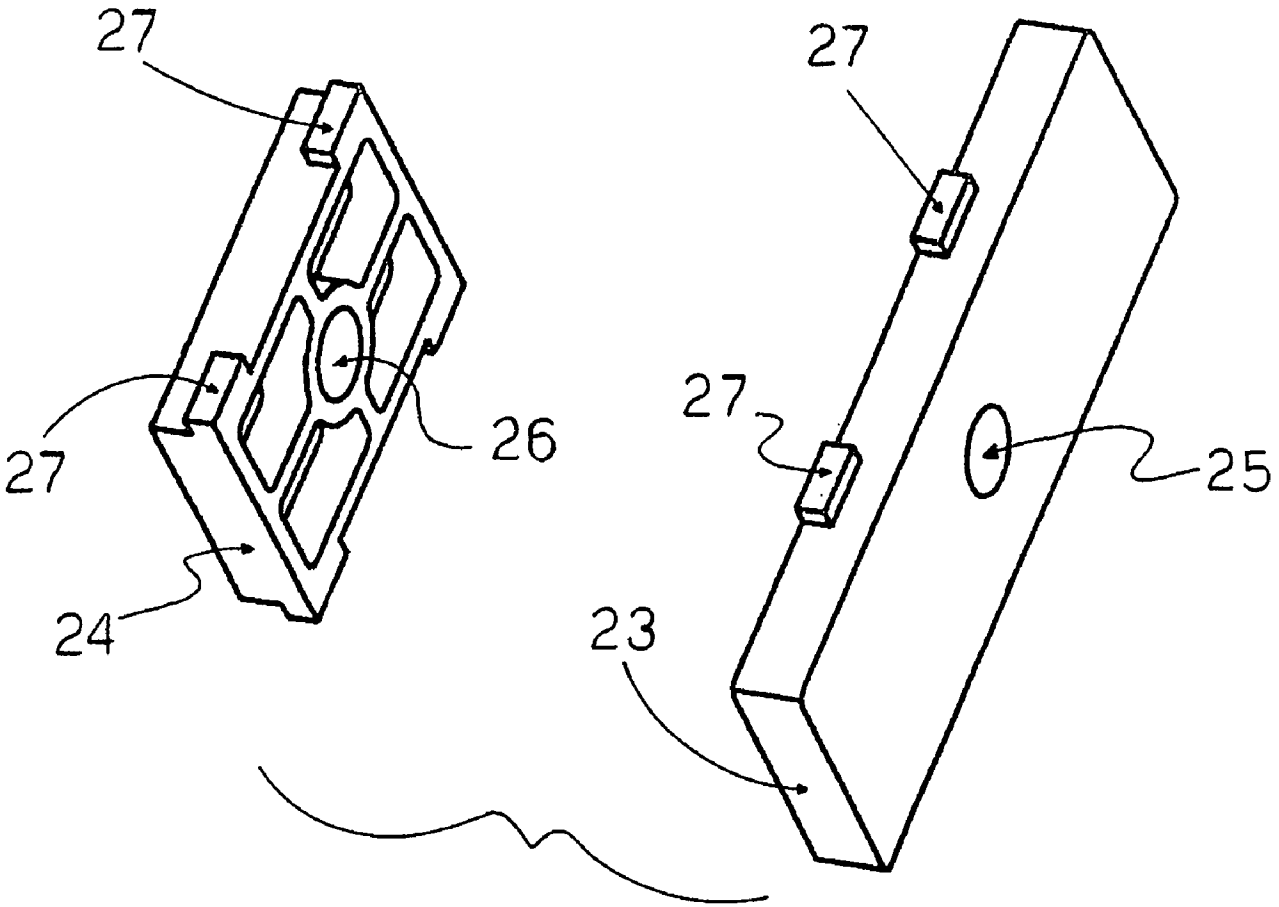
FIG. 3 is a perspective view illustrating guiding means used in the contactor according to the invention.

Further, in the contactor according to the invention, there are provided guiding means which are advantageously positioned outside the yoke 11 in correspondence of at least one of the two openings 13 or 14, and are suitable for guiding the movement of the armature 15 during maneuvers of the contactor; preferably, said guiding means comprise two substantially planar elements 23 and 24, illustrated in FIG. 3, which are made of diamagnetic material such as plastic. As shown, the elements 23 and 24 are provided each with a through hole 25 and 26, and with coupling teeth 27 for coupling to support plates; in particular as shown in FIG. 4, when assembling the actuator 10, there are provided two supporting flanges 28 which are fixed, e.g. riveted, to the opposite sides of the yoke 11; the guiding plates 23 and 24 are positioned at the two opposite upper and lower faces of the yoke 11 with the respective teeth 27 fitted into corresponding seats 29 provided on the supporting flanges 28. In this way, the holes 25, 26 are brought in substantial alignment with the openings 13 and 14, respectively, with the ends 18 and 19 of the pivot 17 passing through them.

Accordingly, the whole architecture of the contactor is simplified, and guiding of the movable parts is optimized according to a solution which eases also manufacturing and mounting with respect to prior art solutions which instead require more precise machining and complicated mounting with mechanical tolerances extremely restricted.

Advantageously, the contactor according to the invention comprises only a unique electromagnetic actuator 10 with its movable armature 15 operatively connected to the movable contact 3 of all the poles through the above mentioned coupling means; in particular said coupling means preferably comprise a single beam 6, made of insulating material, which is positioned transversally with respect to the movement axis 30 of the armature 15. The beam 6 is solidly connected, on one side to the pivot 17, e.g. through clamping means 7, and on the other side to all the actuating rods 4 of the movable contacts 3; in this way, the movable armature 15, the coupling means, and the movable contacts 3 form a substantially monolithic body wherein the driving actuator 10 is directly connected to the movable contacts 3.

Thus, when closing/opening maneuvering occurs, the actuating force generated by the driving actuator 10 is transmitted to the contacts 3 directly and linearly, i.e. without interposition of any intermediate leverage and/or reversing kinematic mechanisms, with all movable elements moving substantially simultaneously in the same sense and direction along the axis 30. As a matter of fact, thanks to this purposive coupling, the head-by head couplings of the contacts 2–3 occurs properly, thus avoiding the inconvenient of the prior art and definitely resulting in an overall improved reliability and repeatability of the operations, which definitely allows increasing the working life of the contactor.

In practice, when it is necessary to open or close the contactor, one of the two coils is electrically excited depending on the type of maneuver to be performed. For example, starting from the closed position of FIG. 5, the first opening coil 20 is energized and generates a force that allows to overcome the retention force applied by the permanent magnets 22 to the movable armature 15 and to produce its movement in the direction of the arrow 31. In particular, as soon as a suitable air gap is formed, the excitation of the coil 20 can be interrupted, and the pivot 17 drags into a linear translation the contacts 3 with the help of the pre-compressed springs 5, until a first stable open position is reached (see FIG. 6) where the pivot 17 is directly held by the sole permanent magnets 22.

An operation in reverse with respect to the one described above is realized exactly in the same manner but opposite way by exciting the second coil 21. In particular, starting from the stable position of FIG. 6, the force generated by the coil 21 allows to overcome the retention force exerted by the permanent magnets 22 and to trigger moving the armature 15 in the direction of the arrow 32; also in this case, the coil 21 can be energized only for the time necessary to form a suitable air gap. By its movement, the armature 15 brings the movable contacts in abutment with the respective fixed contacts 2 where the permanent magnets 22 hold the movable equipment in this second stable position. It is here stressed that during opening/closing maneuvers, the permanent magnets 22 remain always magnetized, i.e. they produce an electromagnetic field.

In practice it has been found that the medium voltage vacuum contactor according to the invention fully achieves the intended aim and objects, providing some significant advantages and improvements over the known prior art. Indeed, as above described, the contactor 100 has a whole structure which is mechanically overally simplified with a number of components reduced and according to a constructive solution which eases mounting; the contactor 100 is also optimized from the electromagnetic point of view thanks to the purposive shape, positioning and dimensioning of the various elements of the actuator 10. In particular, the coils above described allow optimizing also the electronic part of the contactor itself, and avoiding to resort to complicated operative solutions such as de-energizing the permanent magnets which instead remain always magnetized when the contactor 100 is installed in operation. Substantial improvements are achieved in the execution of the maneuvers which occur in an easier and more precise and reliable way, in particular thanks to the purposive configuration of the guiding means and of the transmission mechanism adopted.

The vacuum contactor thus conceived is susceptible of modifications and variations, all of which are within the scope of the inventive concept; for example, it is possible to use the same principle with a different number of poles, the pivot 17 may be realized in more pieces or in a single piece, or it is possible to use a layer of diamagnetic material at the bottom of the yoke, i.e. in correspondence of the first coil 20, so as to reduce the corresponding air gap, et cetera; all the details may furthermore be replaced with technically equivalent elements. In practice, the materials used, so long as they are compatible with the specific use, as well as the dimensions, may be any according to the requirements and the state of the art.

The invention claimed is:

1. A medium voltage vacuum contactor comprising:

for each pole, a vacuum envelope which contains a fixed contact and a corresponding movable contact; and actuating means providing the energy required to move the movable contacts, wherein said actuating means comprise an electromagnetic actuator having a magnetic yoke which has an inner cavity communicating with the outside through at least a first opening, at least one coil accommodated in said cavity, a movable armature which is operatively connected to at least one movable contact through coupling means, said movable armature being mounted axially displaceable in said cavity along an axis of displacement with at least one end protruding from said first opening, and at least one permanent magnet devoted to directly hold said movable armature either in a first stable position in which said fixed and movable contacts are electrically coupled and in a second stable position in which they are electrically separated, and there are provided means for guiding the movement of said movable armature, said guiding means being positioned outside said yoke at at least said first opening, wherein said guiding means comprise at least a first substantially planar element having a through hole suitable to be operatively associated to said first opening and coupling teeth for connecting to supporting flanges fixed to the yoke.

2. The vacuum contactor according to claim 1, wherein said movable armature is directly connected to the movable contact of all poles through said coupling means in such a way that, during maneuvers, said coupling means, the movable armature and all movable contacts move linearly along the axis of displacement of the movable armature substantially simultaneously to each other and in the same direction.

3. The vacuum contactor according to claim 1, wherein said yoke comprises a second opening, opposite to the first opening with respect to the cavity, from which a second end of the movable armature protrudes, and said guiding means comprise a second substantially planar element having a through hole suitable to be operatively associated to said second opening and coupling teeth for connecting to said supporting flanges.

4. The vacuum contactor according to claim 3, wherein said first and second planar elements are positioned outside said yoke with their respective teeth fitted into corresponding seats provided on said supporting flanges and said first and second through holes substantially aligned with said first and second openings, respectively.

5. The vacuum contactor according to claim 1, wherein said coupling means comprise a beam which is positioned transversally with respect to said axis of displacement, said beam being connected on one side to the movable contact of each pole, and on the other side to the movable armature.

6. The vacuum contactor according to claim 1, wherein said electromagnetic actuator comprises a first coil and a second coil which are positioned inside said cavity spaced apart from each other along said axis and around the movable armature.

7. The vacuum contactor according to claim 6, wherein said first and second coils are different from each other.

8. The vacuum contactor according to claim 7, wherein the ratio between the number of turns of said first and second coils is comprised between 0.25 and 0.45.

9. The vacuum contactor according to claim 7, wherein the ratio between the diameters of the turns of said first and second coils is comprised between 1.5 and 1.7.

10. The vacuum contactor according to claim 1, comprising: two permanent magnets which are connected to the yoke with their respective north poles facing each other and the movable armature interposed there between, said permanent magnets being always magnetized during maneuvers.

* * * * *